US006435195B1

(12) United States Patent
Joulia

(10) Patent No.: US 6,435,195 B1
(45) Date of Patent: Aug. 20, 2002

(54) APPLICATOR FOR APPLYING A PRODUCT, AND METHOD OF USING APPLICATOR TO TRANSFER PRODUCTS ONTO A SURFACE

(75) Inventor: Gerard Joulia, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/590,141

(22) Filed: Jun. 9, 2000

(30) Foreign Application Priority Data

Jun. 9, 1999 (FR) ..... 99 07272

(51) Int. Cl.[7] ..... A45D 40/26
(52) U.S. Cl. ..... 132/320; 401/275; 15/212
(58) Field of Search ..... 132/320, 317, 132/218; 15/104.94, 212, 244.2; 401/54, 130, 275

(56) References Cited

U.S. PATENT DOCUMENTS 3,106,736 A * 10/1963 Knapp ..... 15/244.2
3,955,233 A * 5/1976 Nakamura ..... 15/104.94
4,383,539 A * 5/1983 Collins et al ..... 132/320
4,446,880 A * 5/1984 Gueret et al.
4,527,575 A * 7/1985 Vasas ..... 132/218
4,701,168 A * 10/1987 Gammons
4,869,612 A * 9/1989 Mooney et al.
5,137,038 A * 8/1992 Kingsford
5,470,163 A * 11/1995 Komala ..... 401/130
5,615,440 A * 4/1997 Cowan et al.
5,980,960 A * 11/1999 Amitai ..... 132/320

* cited by examiner

*Primary Examiner*—Todd E. Manahan
(74) *Attorney, Agent, or Firm*—Oblon, Spivak, McClelland, Maier & Neustadt, P.C.

(57) ABSTRACT

An applicator for applying a product, includes a handling element secured to an application member. The application member includes a base and an application support is mounted on the application member. The application support defines an application surface. The applicator includes a manipulation member designed to alter a profile of the application surface at right angles to a mid-plane of the base. At least one passage passes through the base. A portion of the manipulation member extends through the at least one passage so that the manipulation member can be placed in engagement with the application support so as to alter the profile of the application surface. The applicator can be used, for example, for treating or applying makeup to the face.

47 Claims, 3 Drawing Sheets

APPLICATOR FOR APPLYING A PRODUCT, AND METHOD OF USING APPLICATOR TO TRANSFER PRODUCTS ONTO A SURFACE

CROSS-REFERENCE TO RELATED APPLICATIONS

This application is related to and claims priority under 37 C.F.R. § 119 to French patent application no. 9907272, filed on Jun. 9, 1999, entitled "APPLICATOR FOR APPLYING A PRODUCT, AND ITS USE IN TRANSFERRING PRODUCTS ONTO A SURFACE SUCH AS THE SKIN," which is hereby incorporated by reference herein.

BACKGROUND OF THE INVENTION

1. Field of the Invention

The present invention generally relates to an applicator for applying a product, for example a cosmetic or dermatological product, to a surface such as the skin. This applicator is of the type having an application member secured to an element for handling and capable of allowing the product to be applied by being transferred from an application surface onto a surface to be treated.

2. Discussion of Background

Among the products that can be applied to the skin, mention may be made of makeup powders, blushers, liquid foundations, eye shadows, dermatological compositions, anti-wrinkle compositions, body care compositions, etc., which are presented in the form of powders, creams, gels or lotions.

The nature of the application member is chosen according to the consistency of the product to be applied and according to the quantity of product to be transferred, which product may be taken from a product reservoir.

Its dimensions, that is to say the size and shape of the application member, are chosen according to the morphology of the surface to be treated.

Numerous applicators are currently commercially available and are intended for applying cosmetic, particularly makeup and body care, products. In general, when these are applicators of the "product-transfer" type, that is to say applicators which are not self-supplied with product, often found in commercially available makeup cases. Applicators of this type are generally used by picking up a dose of product using an application surface, then applying the application surface to an area, for example of the face, that it is desired to treat (or make up). The application of the product may, as necessary, be accompanied by a light rubbing action.

Commercially available applicators of the aforementioned kind often present a problem of comfort of application. Furthermore, they frequently present problems of ergonomics, because, as a general rule, they are often not very easy to use, particularly on account of their small size.

With a view to improving the ergonomics of an applicator for makeup products, patent applications EP-A-0 761 125 and FR-A-2 701 196 propose an applicator comprising a portion for handling and an application portion, articulated to one other. The applicators described in these documents have the drawback that they can be used for only one range of specific products of the mascara or nail varnish type.

Furthermore, in the example of the aforementioned makeup cases, the applicator is often contained in a relatively small-sized compartment. As a result of this, the size of the application member cannot exceed a certain size and cannot therefore, when applying product, cover any more than an area of relatively small size. Specifically, an application member with a relatively large application surface is too bulky to be contained in a makeup case, particularly when it has to be carried around in a handbag.

U.S. Pat. No. 4,446,880 discloses a mascara applicator which has an applicator part intended to be laden with product and the diameter of which can be increased. The applicator part comprises a body forming a hollow elastomer sleeve. A compression device passes through the sleeve and makes it possible, by a pressure exerted parallel to the application surface, to alter the exterior contours of the applicator part. This type of applicator is designed for applying a specific product to the eyelashes and cannot be used for spreading a product out on a support such as the skin. A mechanism such as this offers little latitude regarding the deformations of the application surface that can be obtained. Furthermore, it is relatively tricky to assemble and of somewhat suspect reliability.

U.S. Pat. No. 4,701,168 describes an applicator assembly comprising an application surface which can be impregnated with a liquid product. This liquid product is packaged in a frangible housing. The application surface is mounted on a flexible support which is secured to two parallel tabs emerging at right angles from the support. When these tabs are squeezed together by a user squeezing them between his or her fingers, the frangible housing is pierced and the application surface becomes impregnated with the liquid. During the action of compressing the tabs together the support deforms, leading to a temporary doming of the application surface.

A major drawback of this device stems from the fact that, after numerous bending operations in the course of use, there is a risk that the support and/or the tabs will break as a result of fatigue of the material of which they are made. Furthermore, it is necessary to maintain the compression on the tabs in order to have the domed surface. This is because when the compression on the tabs ceases, the application surface reverts to its initial configuration. Furthermore, this device is not able to allow the configuration of the application surface to be set in a reproducible way. Finally, this type of applicator is not very practical to use and its size entails bulky packaging.

The present invention sets out to overcome the drawbacks of the applicators of the prior art.

SUMMARY OF THE INVENTION

So, one object of the present invention is to provide an applicator, the shape of the application surface of which is variable and adaptable to suit the profile of the object to be treated, for example the profile of the face.

Another object of the present invention is to provide an application member suited to treating the skin, for example facial skin, by transferring product. In addition, according to an objective of ergonomics, the invention is aimed at an applicator whose application member has an orientation which is variable with respect to the orientation of the handling element.

According to yet another object, the present invention sets out to provide an applicator whose size can be minimized in a first, storage, position and which can occupy a second, service, position in which its size is greater. In the storage position this applicator has to be able to be housed, for example, in a makeup case. In the service position it allows, in particular, the area to be treated to be made up easily and accurately.

So, the present invention provides an applicator for applying a product to a surface such as the skin, comprising a handling element secured to an application member formed of a base on which is mounted an application support defining an application surface, characterized in that it comprises a manipulation member designed to alter the profile of the application surface at right angles to a mid-plane of the base, there being at least one passage which passes through the base and through which a portion of the manipulation member can be placed in engagement with the application support so as to alter the profile of the application surface in response to a pressure exerted by the portion approximately at right angles to the application surface.

Advantageously, this portion of the manipulation member, which can be placed in engagement with the application support, is formed of an end portion of the manipulation member.

According to an advantageous aspect of the invention, the application support is secured to the base around at least part of the passage, the portion of the manipulation member being able to be placed in engagement with part of the application support situated facing the passage.

According to an advantageous feature of the present invention, the manipulation member is formed on the handling element. According to a preferred feature, the manipulation member is capable of passing from a first, so-called storage, position into a second, so-called service, position. In the storage position the bulk of the applicator is minimal. According to this feature, in the first position the base is approximately parallel to a longitudinal axis passing through the element for holding, and in the second position a non-zero angle $\alpha$ is formed between the mid-plane of the base and the longitudinal axis.

This arrangement also makes it possible to obtain an orientation of the application surface that can be varied, at will, with respect to the orientation of the handling element, improving the ergonomics of the applicator.

The first position thus constitutes a position of minimum bulk. The second position, in which the bulk is greater, allows for ease of handling of the applicator by the user and gentle application of the product during the operation of treating (supplying makeup to) the skin.

Advantageously, the application surface is configured in such a way as to facilitate the attachment of the product to be applied. It is formed of an application surface secured to the rigid base of the application member.

Advantageously, the application support, including its surface that is intended to become laden with product, is elastically deformable. The term "elastically deformable" is meant to denote a support capable of deforming elastically in response to appropriate stress and of reverting to its initial shape when the stress ceases. Advantageously also, the application support may be elastically compressible, which makes the product easier to release at the time of application. Through this contrivance, it is also possible to improve application comfort.

The ability of the application support to curve, in response to the action of the manipulation member, and to return by elasticity to its initial shape when the stress ceases, is associated with the elasticity of the material of which the application support is made. The ability of such a material to bend may also be characterized by its bending modulus. In general, the materials envisaged by the invention have a Young's modulus in bending which is at most equal to 200 MPa. The flexibility may result from the nature of the material of which the application support is made and/or from its configuration. When the application support consists of a foam, the flexibility also depends on the density of the foam (the size and number of cavities).

According to one advantageous embodiment, in the storage position the application surface is approximately flat whereas in the service position it is approximately domed.

The free end of the manipulation member which engages with the application support may have various contours, according to the profile that it is desired to give to the application surface, in the service position. Furthermore, the free end of the manipulation member, depending on the angular position of the element for holding with respect to the orientation of the application support, gives a more or less pronounced alteration of the profile of the application surface.

As far as the shape of the application support is concerned, this advantageously has a lateral edge that forms a continuous curve, for example of oval shape. More specifically, this lateral edge may further comprise at least one region of concave shape. This feature allows the shape of the applicator to be tailored, for example to suit the application of makeup to the eyelids or other contours around the eyes or nose.

The handling element may be mounted on the application member by means of articulation means made on a portion of the handling element and of the base, respectively. For this purpose, the manipulation member may comprise a hinge which has a pivot pin. In this case, a first part of the articulation is formed by the application member and a second part, capable of collaborating with the first, is formed by the handling element.

According to one particular embodiment, the articulation means may be configured in such a way that the application member is removable. Thus, the application member may constitute an interchangeable refill, it being possible for the application support to be pre-impregnated with a product that can be crumbled. The fact of having a removable application member also makes it possible, as necessary, to clean the application support.

According to another embodiment, the application support may comprise a raised pattern, in particular constituting a logo or a decorative element, for example allowing a temporary "tattoo" to be created on the skin.

As far as the application support is concerned, this may be made of natural or synthetic rubber, particularly of polyurethane or thermoplastic elastomer. It may consist of a cellular foam with closed cells, open cells or semi-open cells. The application support may have a flocked coating encouraging the holding of the product and making the layer of product easier to spread out evenly after application.

Advantageously, the application support has a mean thickness of from about 1 mm to about 4 mm.

Furthermore, in order to be able to position the handling element in a definite position with respect to the application support during use, the applicator may comprise means for locking the application surface in a determined orientation with respect to the handling element, in the service position.

More specifically, these positioning means may comprise at least one elastic tongue located near one of the ends of the passage, this tongue having at least one profile capable of collaborating with a complimentary profile formed by the handling element, this profile being able to be negotiated as the element for holding pivots towards the storage position or towards the service position.

The applicator which has just been described can be used, in particular, for applying a liquid, pasty or solid product that can be crumbled to the skin or its superficial body growths.

In particular, this applicator is intended for applying a treatment product, such as an anti-wrinkle product, or a makeup product such as a loose or compact powder, a coloured paste, an eye shadow, a blusher or a foundation.

According to another method of use, the applicator of the invention can be used for creating a temporary "tattoo" on the skin by transferring an appropriate product.

In practice, the applicator is used for picking up the product to be applied from an appropriate reservoir. This reservoir may consist of a pot filled with cream or loose powder, a compact powder placed in a makeup case, an appropriate support impregnated with liquid, particularly of the inkpad type, etc.

BRIEF DESCRIPTION OF THE DRAWING FIGURES

Other objects of the invention will become evident in greater detail from reading the description which will follow, of some embodiments of the invention which are given by way of purely illustrative and non-limiting examples, depicted in the appended drawings.

DETAILED DESCRIPTION OF THE PREFERRED EMBODIMENTS

Figure 1:
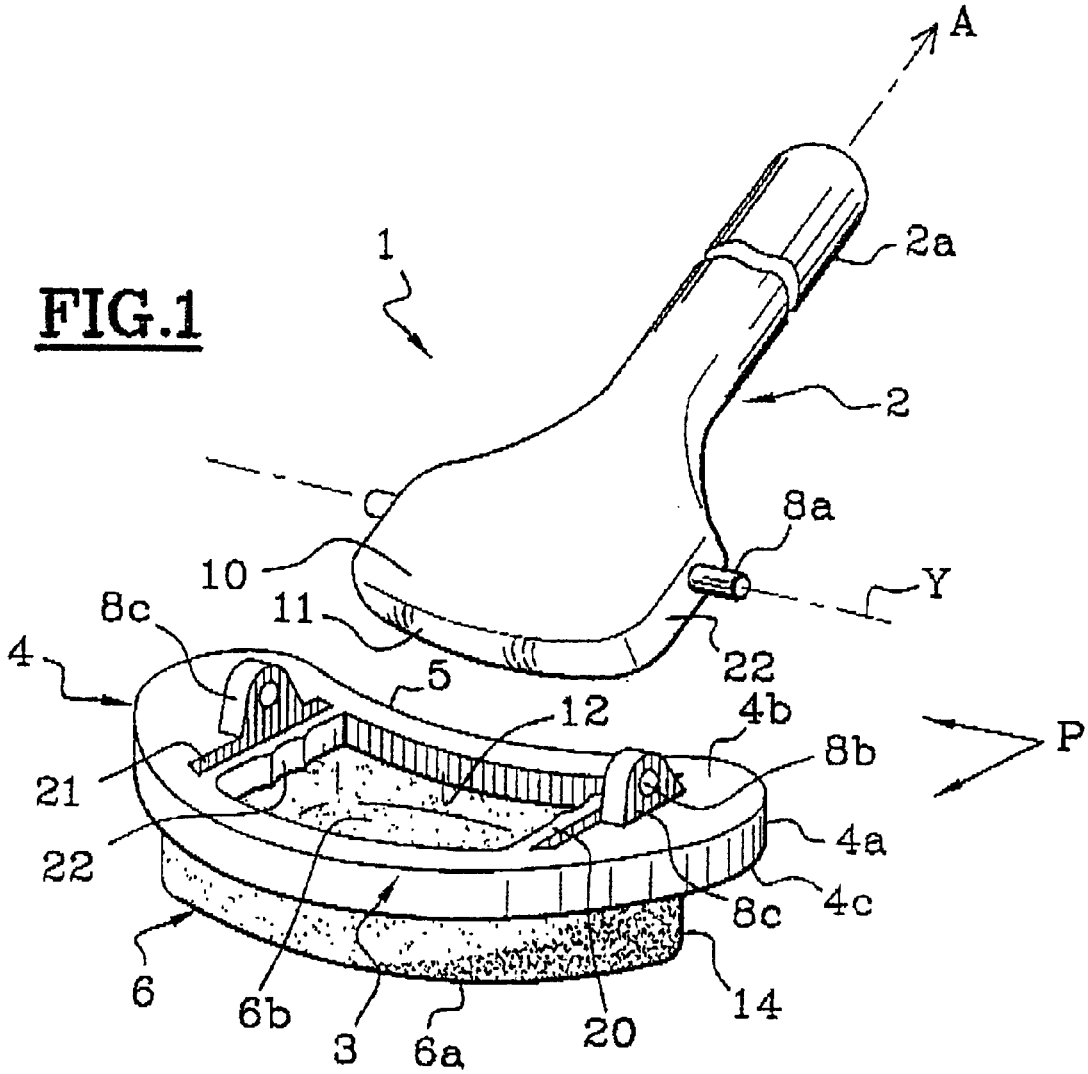
FIG. 1 depicts an exploded perspective view of an applicator according to a first embodiment of the present invention.

With reference in particular to FIGS. 1 to 5 it is possible to see an applicator, denoted in its entirety by the reference 1. The applicator 1 is made up of a handling element 2, which allows the applicator to be held in the hand, and of an application member 4 comprising a rigid base 3 mounted so that it can pivot on the handling element.

As can be seen, particularly in FIG. 1, the handling element 2 has an elongate shape, of axis A, a first free end 2*a* of which forms an approximately cylindrical handle. A second end 11, at the opposite end to the first, is located at the end of a flattened portion 10, which is markedly wider than the handle 2*a*. This second end forms, with the handling element 2, a manipulation member as will be explained hereinafter. The flattened portion 10 is delimited by two lateral flanks 22, each bearing an articulation journal 8*a*. The two journals 8*a* are centred on an axis Y perpendicular to the axis A. The handling element 2 is advantageously made by moulding a rigid or semirigid thermoplastic. The greater part of the flattened portion 10 is on the opposite side to the handle 2*a*, with respect to the axis Y, so that it can execute a sweeping movement as the element for holding is pivoted.

The rigid base 3 of the application member 4 extends approximately parallel to a mid-plane P and has an approximately flat shape with a rounded contour 4*a*. This contour 4*a* may have an oval, circular or "kidney bean" shape, exhibiting a concave portion 5, as illustrated in detail in FIG. 7.

In FIG. 1, the base 3 comprises an upper face 4*b* and a lower face 4*c*. The upper face 4*b* carries articulation means 8*b*, 8*c* capable of collaborating each with one of the two journals 8*a* of the element for holding. For this purpose, two emerging portions 8*b*, 8*c* are located some distance apart, this distance approximately corresponding to the width of the flattened portion 10. Each portion 8*c* has a bore 8*b* intended to house a journal 8*a*. This arrangement constitutes an articulation allowing the handling element 2 to be pivoted with respect to the application member 4. Thus, various service positions of the handling element can be obtained, as desired, these ranging between a position of minimum bulk or storage position (in which the handling element is parallel to the base) and a position of maximum bulk, whereby the axis A is approximately at right angles to a mid-plane P of the base 3. Depending on the ergonomics required by the user, the service position is set to a position located between the storage position and the position of maximum bulk (that is to say when the axis A is at right angles to mid-plane P).

The base 3 of the application member 4 is further provided with an opening or passage 12, the size of which is such that the portion 10 of the handling element can pass through it as the handling element 2 is pivoted with respect to the application member 4.

The lower face 4*c* of the base 3 is covered with an application support 6 defining an application surface 6*a* and a rear face 6*b* approximately parallel one with respect to the other. A rim 4*d* of the base surrounds the lateral edge 14 of the application support (see FIGS. 3 and 5).

The application support 6 is elastically deformable. According to a preferred embodiment of the invention, it consists of a sheet of elastomer, a sheet of open-cell, semi-open-cell or closed-cell foam, the application surface 6*a* of which may be covered with a flocked coating.

A catching region 6*c* is provided, to fix the periphery of the application support 6 to the lower face 4*c* of the base 3. The application support may be attached by bonding, thermal welding, ultrasonic welding or any other appropriate means.

As illustrated, particularly in FIG. 1, visible through the opening 12 is the rear face 6*b* of the application support, which is the opposite face to the application surface 6*a*.

Once the handling element 2 has been mounted on the application member 4 by engaging the journals 8*a* in the bores 8*b*, the applicator 1 is ready for use.

Figure 2:
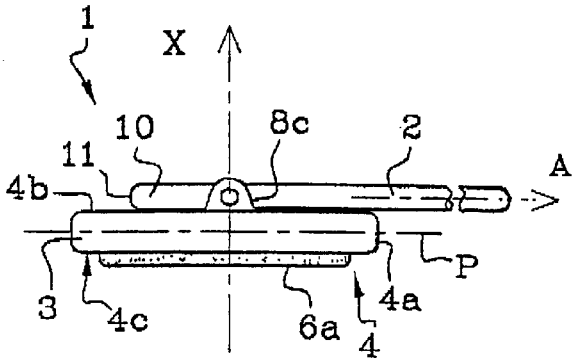
FIG. 2 shows a side view of the applicator of FIG. 1, in the storage position.
Figure 3:
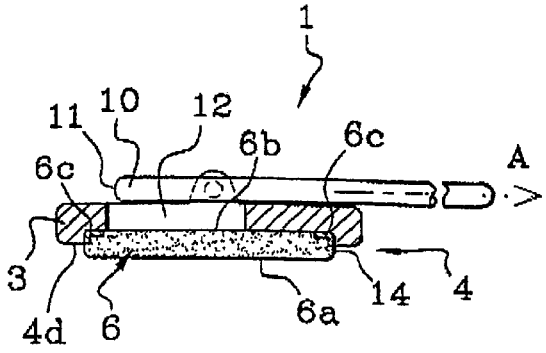
FIG. 3 depicts a view in axial section of the applicator according to FIG. 2, in the storage position.

Thus, FIGS. 2 and 3 show the applicator 1 in the storage position. In this position, the axis A passing through the handling element 2 is approximately parallel to the mid-plane P of the application member 4 (see FIG. 2). It can be seen that, in this position, the applicator in its entirety has a minimum bulk which allows it to be stored, for example, in an appropriate compartment of a makeup case. Furthermore, in this position, there is no contact between the portion 11 of the handling element 2 and the application support 6. In consequence, the application support 6 is in its position of rest and forms an approximately flat surface 6*a*.

Figure 4:
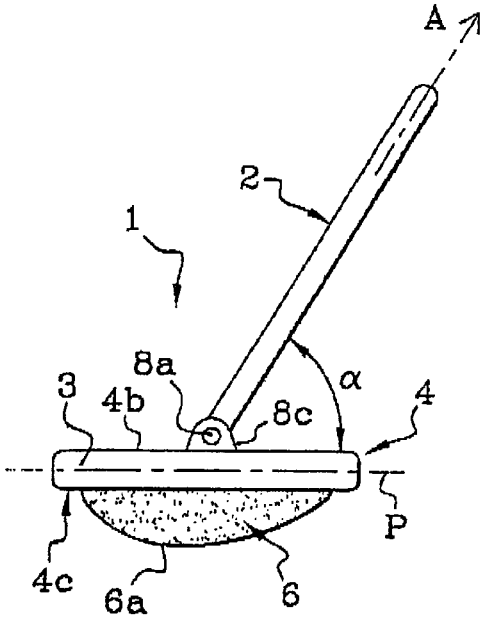
FIG. 4 shows a side view of the applicator of FIG. 1, in the service position.

By lifting the handle 2*a* up with respect to the application member, an angle $\alpha$ is formed between the axis A and the plane P of the base 3 (see FIG. 4). In practice, the angle $\alpha$ is set to between about 40° and about 90°, according to the user's requirements. Thus, during application, ergonomic actions can be performed, according to which point of the face is to be treated (made up).

Figure 5:
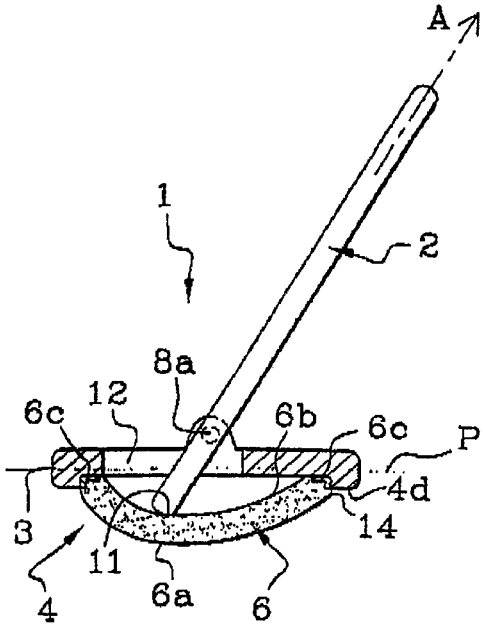
FIG. 5 depicts a view in axial section of the applicator according to FIG. 4, in the service position.

When the applicator is brought into the service position, as illustrated in FIGS. 4 and 5, the portion 11 of the element for holding, which is of a rounded shape, comes into contact with the rear face 6*b* of the application support 6. The shape of the portion 11 of the handling element 2 may vary and is advantageously suited to imparting an appropriate convexity to the application surface 6*a* tailored to best match the surface to be treated. A domed configuration such as this allows the product to be applied very accurately, particularly to regions of the face which are difficult to access.

Furthermore, means 20, 21, 22, 24 may be provided for locking the position of the handle 2*a* with respect to the plane P of the base 3. As visible in greater detail in FIG. 6, there are two slots 21 formed one on each side of the opening 12. The slots 21 partially bound slender tongues 20.

Each tongue 20 is equipped with a pair of approximately parallel ribs 24 which are positioned in such a way that the lateral flank 22 of the element for holding, in the service position, can be housed between the ribs 24. In this position, the lateral flanks 22 are held in position by elastic clamping between the tongues 20.

Figure 6:
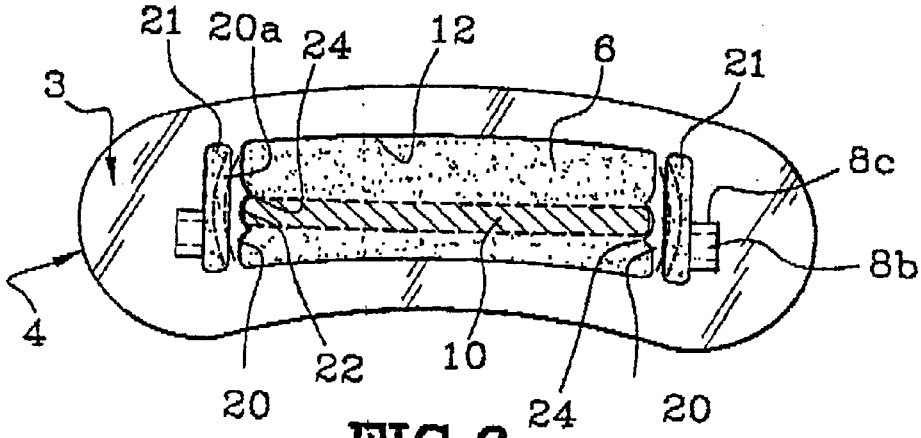
FIG. 6 depicts a detailed view of an applicator member equipped with means for positioning the handling element.

When the handling element 2 is folded back into the storage position, the lateral flanks 22 exert pressure on the ribs 24, causing the tongues 20 to deform elastically outwards to temporarily occupy the positions 20*a* drawn in dotted line in FIG. 6. Once the portion 10 and the tongues 20 have completely disengaged, the tongues return to their initial position through elasticity, and the application surface 6*a* reverts to its flat shape.

To perform treatment, for example to apply makeup to the eyelids, the user takes the applicator out of a storage compartment. The applicator is then in the folded form as illustrated in FIGS. 2 and 3. Next, the user brings the handle 2*a* into the service position with respect to the application member 4 (see FIGS. 4 and 5) to cause the application surface 6*a* to adopt a domed configuration. The amplitude and shape of the domed configuration depend, as mentioned hereinabove, on the shape of the portion 11 of the element for holding, and on its position with respect to the axis of articulation Y.

By bringing the application surface 6*a* into contact with the product to be applied, for example a loose or compact powder, a paste, or a pad impregnated with liquid such as a lotion or alternatively with a cream, the user picks up an appropriate dose of product. The application support becomes laden with product by a capillarity effect, by impregnation or absorption of the product, or alternatively simply by rubbing the applicator across a block of the product that can be crumbled. The user then proceeds to apply the product, by applying the product-laden application surface 6*a* to an area of skin such as, for example, the eyelids or the cheeks.

In the service position, the product can be applied easily and comfortably because of the way the applicator sits in the hand. By virtue of the domed application surface 6*a*, the product is applied gently and accurately.

After use, as appropriate, the application support may be cleaned. By folding the handle 2*a* back down into the storage position (FIGS. 2 and 3), the applicator 1 can be put back away in its initial housing.

According to another possibility, the application member 4 may constitute a refill which is pre-laden with product, obtained by impregnating the application surface 6*a* beforehand. In this case, the application member is advantageously a use-once member which is disposed of after use.

Figure 7:
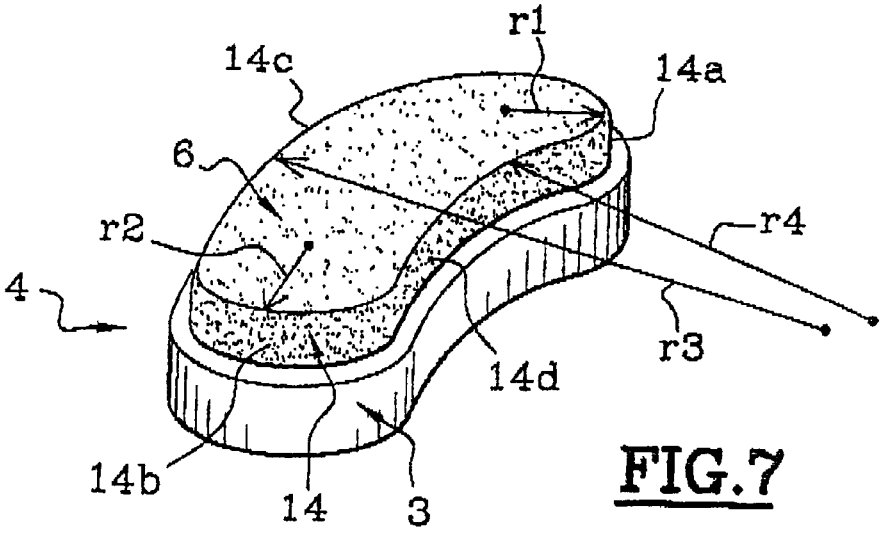
FIG. 7 shows a perspective view of a preferred form of the application member.

FIG. 7 depicts details of a preferred embodiment of the application member 4, designed in particular for applying makeup to the eyelids.

The application member according to FIG. 7 has two ends, a first end 14*a* and a second end 14*b*. The two ends have a rounded shape, a radius of curvature $r_1$ of the first end 14*a* being shorter than a radius of curvature $r_2$ of the second end 14*b*. In the example under consideration, $r_1$ is about 3.5 mm, $r_2$ being about 7.5 mm. The distance between the two ends 14*a* and 14*b* is about 33 mm.

The two ends 14*a*, 14*b* are joined together by two edges 14*c* and 14*d*. The edge 14*c* is convex and has a radius of curvature $r_3$. The edge 14*d* is concave and has a radius of curvature of $r_4$. In the embodiment illustrated, $r_3$ is greater than $r_4$. This makes it possible for the lateral edges 14*c*, 14*d* to converge slightly towards the end 14*a*.

In the example under consideration, the radius $r_1$ is tailored to the curvature of the upper eyelid. Typically, $r_3$ is of the order of 20 mm and $r_4$ is of the order of 16 mm.

The thickness of the application support 6 is chosen according to the flexibility of the material used to make the application support 6. In general, this thickness is from about 1 mm to about 4 mm.

The material of which the application element 6 is made is an elastically deformable material, particularly a material which is elastically deformable in terms of bending, compression and elongation. It can be chosen from natural or synthetic rubbers and preferably from thermoplastic elastomers. Advantageously, a cellular elastomer foam is chosen. The surface of the application element 6 may possibly be flocked, thus improving its ability to hold the product P and therefore its autonomy, particularly when the product is a powder.

Figure 8:
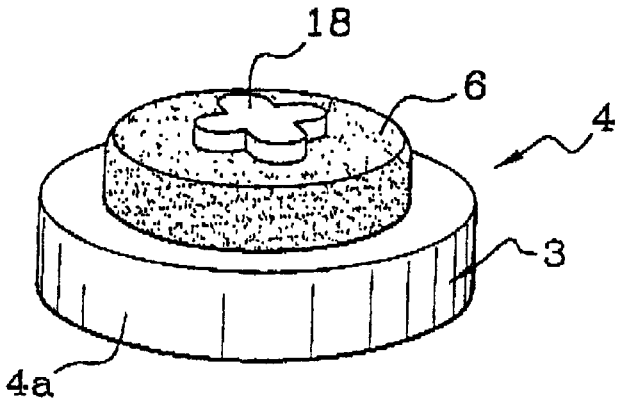
FIG. 8 shows an alternative form of the application member, allowing makeup to be applied tattoo style.

FIG. 8 depicts an applicator member 4 comprising a rigid base 3 defining a lateral edge 4*a* which is approximately circular. The base 3 can be mounted on a pivoting handling element 2, as described hereinabove. This application member 4 is intended to allow decorative makeup effects to be produced, by a technique known as "tattooing".

Mounted on the base 3 is an elastically compressible disc 6 made of closed-cell foam. Fixed to the center of the disc 6 is a projecting pattern 18 forming a decorative pattern or a logo. The element 18 is made of a material capable of holding on to a makeup product such as a colored paste or colored ink. As the handling element is brought into the service position, the surface of the roundel 6 becomes domed, making it easier, on the one hand, for the projecting pattern 18 to become laden with product and, on the other hand, allowing the makeup to be applied precisely and cleanly to the chosen spot. Thus, using a reservoir of product, for example of the inkpad type, the user impregnates the pattern 18 with product and transfers the product onto the skin, where the decorative pattern is deposited.

After use, the handle 2*a* is folded down onto the application member, in a way similar to the storage position shown in FIGS. 2 and 3 in which it has a minimum bulk, so that the applicator can be put away.

In the foregoing detailed description, reference was made to some particular embodiments of the invention. It is obvious that variations can be made thereto without departing from the spirit of the invention as claimed hereinafter.

What is claimed as new and desired to be secured by Letters Patent of the United States is:

1. An applicator for applying a product, comprising:

a handling element;

an application member to which said handling element is secured, wherein said application member includes a base;

an application support mounted on said base, wherein said application support defines an application surface and includes a manipulation member for altering a profile of said application surface at right angles to a mid-plane of said base (3); and at least one passage passing through said base, wherein a portion of said manipulation member can be placed in engagement with said application support through said at least one passage so that, in response to a pressure exerted by said portion of said manipulation member at approximately right angles to said application surface, said profile of said application surface is altered.

2. The applicator according to claim 1, wherein said portion of said manipulation member, which can be placed in engagement with said application support, is formed of an end portion of said manipulation member.

3. The applicator according to claim 1, wherein said application support is secured to said base around at least part of the said at least one passage, said portion of said manipulation member being able to be placed in engagement with part of said application support situated facing said at least one passage.

4. The applicator according to claim 1, wherein said manipulation member is formed on said handling element.

5. The applicator according to claim 1, wherein said application support is elastically deformable.

6. The applicator according to claim 1, wherein said application support has a lateral edge that forms a continuous curve.

7. The applicator according to claim 1, wherein said application surface is covered with a flocked coating.

8. The applicator according to claim 1, wherein said application support is made of any one of natural rubber, synthetic rubber, foam elastomer, and thermoplastic elastomer.

9. The applicator according to claim 1, wherein said application support has a thickness of from about 1 mm to about 4 mm.

10. An applicator as recited in claim 1, wherein said application support includes a rear face disposed on a side of said application support opposite to said application surface, and wherein a portion of said manipulation member is placed in engagement with said rear face to alter said profile of said application surface in response to pressure exerted by said portion of said manipulation member against said rear face.

11. An applicator for applying a product, comprising:

a handling element;

an application member to which said handling element is secured, wherein said application member includes a base;

an application support mounted on said base, wherein said application support defines an application surface, and wherein said applicator includes a manipulation member for altering a profile of said application surface at right angles to a mid-plane of said base, and at least one passage passing through said base, wherein a portion of said manipulation member can be placed in engagement with said application support through said at least one passage so that, in response to a pressure exerted by said portion of said manipulation member at approximately right angles to said application surface, said profile of said application surface is altered, wherein said application support has a lateral edge that forms a continuous curve, and wherein said lateral edge includes at least one region of concave shape.

12. An applicator for applying a product, comprising:

a handling element;

an application member to which said handling element is secured, wherein said application member includes a base;

an application support mounted on said base, wherein said application support defines an application surface, and wherein said applicator includes a manipulation member for altering a profile of said application surface at right angles to a mid-plane of said base, and at least one passage passing through said base, wherein a portion of said manipulation member can be placed in engagement with said application support through said at least one passage so that, in response to a pressure exerted by said portion of said manipulation member at approximately right angles to said application surface, said profile of said application surface is altered, wherein the applicator further comprises articulation means defining an axis of pivoting and connecting said application member to said handling element.

13. The applicator according to claim 12, wherein said application member is removably mounted with respect to said handling element.

14. The applicator according to claim 13, wherein said application member constitutes an interchangeable refill, said application support being impregnated with a product that can be crumbled.

15. An applicator for applying a product, comprising:

a handling element;

an application member to which said handling element is secured, wherein said application member includes a base;

an application support mounted on said base, wherein said application support defines an application surface, and wherein said applicator includes a manipulation member for altering a profile of said application surface at right angles to a mid-plane of said base, and at least one passage passing through said base, wherein a portion of said manipulation member can be placed in engagement with said application support through said at least one passage so that, in response to a pressure exerted by said portion of said manipulation member at approximately right angles to said application surface, said profile of said application surface is altered, wherein a shape of said profile of said application surface after being altered depends on an angular position of an element of said manipulation member with respect to said base.

16. An applicator for applying a product, comprising:

a handling element;

an application member to which said handling element is secured, wherein said application member includes a base;

an application support mounted on said base, wherein said application support defines an application surface, and wherein said applicator includes a manipulation member for altering a profile of said application surface at right angles to a mid-plane of said base, and at least one passage passing through said base, wherein a portion of said manipulation member can be placed in engagement with said application support through said at least one passage so that, in response to a pressure exerted by said portion of said manipulation member at approximately right angles to said application surface, said profile of said application surface is altered, wherein said application surface has a raised pattern constituting any one of a logo and a decorative element.

17. An applicator for applying a product, comprising:

a handling element;

an application member to which said handling element is secured, wherein said application member includes a base;

an application support mounted on said base, wherein said application support defines an application surface, and wherein said applicator includes a manipulation member for altering a profile of said application surface at right angles to a mid-plane of said base, and at least one passage passing through said base, wherein a portion of said manipulation member can be placed in engagement with said application support through said at least one passage so that, in response to a pressure exerted by said portion of said manipulation member at approximately right angles to said application surface, said profile of said application surface is altered, wherein said manipulation member is capable of passing from a first position to a second position, and said base, when said manipulation member is in said first position, is approximately parallel to an axis passing through said handling element, and in that a non-zero angle $\alpha$ is formed between a plane and said axis when said manipulation member is in said second position.

18. The applicator according to claim 17, wherein said application surface is approximately domed, when said manipulation member is in said second position.

19. The applicator according to claim 17, wherein said application surface is approximately flat, when said manipulation member is in said first position.

20. The applicator according to claim 17, further comprising positioning means for locking said application surface with respect to said handling element, in said second position.

21. The applicator according to claim 20, wherein said positioning means includes at least one elastic tongue located near one end of said passage, said at least one elastic tongue having at least one profile capable of collaborating with a complementary profile formed by said handling element, said at least one profile being negotiated as said handling element passes into any one of said first position and said second position.

22. A method of using an applicator including a handling element, an application member to which said handling element is secured, wherein said application member includes a base, an application support mounted on said base, wherein said application support defines an application surface and includes a manipulation member for altering a profile of said application surface at right angles to a mid-plane of said base, and at least one passage passing through said base, the method comprising placing a portion of said manipulation member in engagement with said application support through said at least one passage so that, in response to a pressure exerted by said portion of said manipulation member at approximately right angles to said application surface, said profile of said application surface is altered, said method further comprising the steps of:

bringing said application surface into contact with any one of a treatment product and a makeup product to be applied; and applying any one of said treatment product and said makeup product to skin of a user.

23. A method as recited in claim 22, wherein said application support includes a rear face disposed on a side of said application support opposite to said application surface, and wherein the method further comprises, in placing a portion of said manipulation member in engagement with said application support, placing said manipulation member in engagement with said rear face of said application support to alter said profile of said application surface in response to pressure exerted by said manipulation member against said rear face.

24. An applicator for applying a product comprising:

(a) an application member, said application member comprising an application surface;

(b) a handling element comprising:

(i) a movable handle disposed at a first end of said handling element, wherein said movable handle is movable with respect to said application member;

(ii) a movable manipulation member disposed at a second end of said handling element, wherein said movable manipulation member moves in response to movement of said movable handle, and further wherein upon movement of said movable manipulation member said movable manipulation member contacts said application member and alters a profile of said application surface; and wherein said handling element is coupled to said application member at a location between said first end and said second end of said handling element.

25. An applicator as recited in claim 24, wherein said handling element is pivotably coupled to said application member at said location between said first end and said second end whereby said movable handle is pivotably movable.

26. An applicator as recited in claim 25, wherein the handling element is pivotably coupled to said application member with at least one journal disposed in at least one bore.

27. An applicator as recited in claim 25, wherein the handling element is pivotably coupled to said applicator member with first and second journals respectively disposed in first and second bores.

28. An applicator as recited in claim 24, wherein said handling element includes a flattened portion which is wider than said movable handle, and wherein said second end of said handling element is disposed at an end of said flattened portion whereby said movable manipulation member is wider than said movable handle.

29. An applicator as recited in claim 28, wherein said location between said first end and said second end at which said handling element is coupled to said applicator member is located in said flattened portion of said handling element.

30. An applicator as recited in claim 24, wherein said application member includes a base, and wherein said handling element is pivotably coupled to said base.

31. An applicator as recited in claim 30, wherein said base includes means for holding said movable handle in a plurality of selected positions.

32. An applicator as recited in claim 30, wherein said movable handle is movable between a storage position in which said movable handle is substantially parallel to said base and a plurality of service positions in which said movable handle is disposed at an angle with respect to said base.

33. An applicator as recited in claim 32, wherein when said movable handle is in one of said plurality of service positions, said application surface is curved.

34. An applicator as recited in claim 33, wherein when said movable handle is in said storage position said application surface is substantially flat.

35. An applicator as recited in claim 24, wherein said application member includes a base having first and second surfaces and an opening extending through said base from said first surface to said second surface, and wherein said application member further includes an application support disposed on said second surface, and wherein said application support includes a rear face, and further wherein said application surface is disposed on a side of said application support opposite to said rear face.

36. An applicator as recited in claim 35, wherein rear face covers said opening on said second surface of said base.

37. An applicator as recited in claim 36, wherein said handling element is coupled to said base at a location adjacent to said first surface of said base.

38. An applicator as recited in claim 36, wherein movement of said movable handle causes said movable manipulation member to move through said opening to contact said rear face.

39. An applicator as recited in claim 38, wherein at least one rib extends along said opening to hold said handling element in at least one selected position in which said movable manipulation member is in contact with said rear face of said application support.

40. An applicator as recited in claim 39, wherein a plurality of said ribs are provided to hold said handling element in a plurality of selected positions in which said movable manipulation member is in contact with said rear face of said application support.

41. An applicator as recited in claim 38, wherein said handling element includes a flattened portion having a width which is wider than said movable handle, and wherein said movable manipulation member is disposed on said flattened portion.

42. An applicator as recited in claim 41, wherein said movable manipulation member includes a domed surface which contacts said rear face.

43. An applicator as recited in claim 24, wherein said application member comprises an application support having a rear face and wherein said application surface is disposed on a side of said application support opposite to said rear face, and further wherein said manipulation member contacts said rear face to alter the profile of said application surface.

44. A method of using an applicator including a handling element, an application member to which said handling element is secured, wherein said application member includes a base, an application support mounted on said base, wherein said application support defines an application surface and includes a manipulation member for altering a profile of said application surface at right angles to a mid-plane of said base, and at least one passage passing through said base, the method comprising placing a portion of said manipulation member in engagement with said application support through said at least one passage so that, in response to a pressure exerted by said portion of said manipulation member at approximately right angles to said application surface, said profile of said application surface is altered, said method further comprising the steps of:

bringing said application surface into contact with a crumblable product to be applied; and applying said crumblable product to any one of skin of a user and superficial body growths of said skin of said user.

45. A method as recited in claim 44, wherein said application support includes a rear face disposed on a side of said application support opposite to said application surface, and wherein the method further comprises, in placing a portion of said manipulation member in engagement with said application support, placing said manipulation member in engagement with said rear face of said application support to alter said profile of said application surface in response to pressure exerted by said manipulation member against said rear face.

46. A method of using an applicator including a handling element, an application member to which said handling element is secured, wherein said application member includes a base, an application support mounted on said base, wherein said application support defines an application surface and includes a manipulation member for altering a profile of said application surface at right angles to a mid-plane of said base, and at least one passage passing through said base, the method comprising placing a portion of said manipulation member in engagement with said application support through said at least one passage so that, in response to a pressure exerted by said portion of said manipulation member at approximately right angles to said application surface, said profile of said application surface is altered, said method further comprising the steps of:

bringing said application surface into contact with a product to be applied; and creating a temporary tattoo on skin of a user by transferring said product.

47. A method as recited in claim 46, wherein said application support includes a rear face disposed on a side of said application support opposite to said application surface, and wherein the method further comprises, in placing a portion of said manipulation member in engagement with said application support, placing said manipulation member in engagement with said rear face of said application support to alter said profile of said application surface in response to pressure exerted by said manipulation member against said rear face.

* * * * *